United States Patent [19]

Menck

[11] Patent Number: 5,069,110

[45] Date of Patent: Dec. 3, 1991

[54] IMPACT BUFFERING RECOIL MECHANISM

[76] Inventor: Thomas W. Menck, 5703 S. 77 St., Ralston, Nebr. 68127

[21] Appl. No.: 682,632

[22] Filed: Apr. 9, 1991

[51] Int. Cl.[5] ..... F41A 3/80

[52] U.S. Cl. ..... 89/198; 89/196

[58] Field of Search ..... 89/163, 196, 198, 199

[56] References Cited

U.S. PATENT DOCUMENTS

| | | | |
|---|---|---|---|
| 580,924 | 4/1897 | Browning | 89/163 |
| 2,522,192 | 9/1948 | Porter | 89/198 |
| 3,115,063 | 12/1963 | Browning | 89/198 |
| 3,417,660 | 12/1968 | Harbrecht | 89/198 |
| 3,731,590 | 5/1973 | Zimmerman, Jr. | 89/163 |
| 3,756,121 | 9/1973 | Roy | 89/196 |
| 3,901,125 | 8/1975 | Raville | 89/163 |
| 4,031,808 | 6/1977 | Raville | 89/163 |
| 4,173,169 | 11/1979 | Yates et al. | 89/196 |
| 4,201,113 | 5/1980 | Seecamp | 89/199 |
| 4,344,352 | 8/1982 | Yates et al. | 89/198 |
| 4,388,855 | 6/1983 | Sokolovsky | 89/198 |
| 4,485,723 | 12/1984 | Sarony | 89/163 |
| 4,498,369 | 2/1985 | Kaiser | 89/198 |
| 4,522,107 | 6/1985 | Woodcock et al. | 89/196 |
| 4,754,689 | 7/1988 | Grehl | 89/196 |
| 4,972,760 | 11/1990 | McDonnell | 89/196 |
| 4,974,493 | 12/1990 | Yeffman | 89/198 |

*Primary Examiner*—Richard W. Wendtland

[57] ABSTRACT

A impact-buffering recoil mechanism for firearms includes a buffer (3)(4) moveably mounted on a guiding member (1)(17) between a plurality of coil springs (2)(5). The mechanism is positioned in the firearm so that the moveable buffer travels from a position of repose to interpose between moveable parts (7) of the firearm (16) set into motion by the firing of the firearm and the frame of the firearm (8). This interposing will bring the moveable parts to an orderly halt while dissipating impact energy that would normally be transmitted to the frame and hence to the shooter.

14 Claims, 2 Drawing Sheets

IMPACT BUFFERING RECOIL MECHANISM

BACKGROUND

1. Field of Invention

This invention relates to firearms, in particular to the buffering of the impact of movable parts placed into motion by the firing of the firearm that would be normally transmitted to the frame of the firearm when the movement is terminated.

2. Description of Prior Art

Many firearms have moveable parts that move in response to the firing of the firearm, a process commonly called recoil. The rearward movement of these parts is terminated by their slamming into the frame of the firearm. Such pounding reduces the accuracy of the firearm and can reduce the service life of the component parts through deformation or breakage. The shock of the pounding from firing is fatiguing to the shooter and will lengthen the amount of time necessary to realign the sights before accurately firing subsequent shots.

Recent introduction of more powerful ammunition has increased the problem, resulting in the overstressing of firearms that were originally designed for less powerful ammunition. Recent trends of arming the police with more powerful firearms has resulted in the issuing of firearms beyond the recoil tolerance levels of many police officers.

Prior art such as U.S. Pat. No. 3,756,121 to Roy (1973), U.S. Pat. No. 3,901,125 to Raville (1975), U.S. Pat. No. 4,522,107 to Woodcock et al. (1985) and U.S. Pat. No. 4,754,689 to Grehl (1988) employed the use of a buffer mechanism installed between the rear of the recoil spring and the frame that would be entrapped between the frame and a part moving to the rear upon firing. Such a mechanism is clearly inapplicable for firearm designs wherein the rear of the recoil spring is seated in a well in the frame below the surface of the frame impacted by the moving part. As a result an entire type of firearm design that features a recoil spring the rear of which is seated in a well in the frame cannot be protected from impact by these means.

U.S. Pat. No. 2,522,192 to Porter (1950) employs a spring-loaded plunger that protrudes from the front of the recoil spring guide that contacts the moving part at a point in the center of the front of the recoil spring. Such a mechanism is clearly inapplicable for firearm designs wherein the recoil spring guide extends through the moving part past the surf-ace contacted by the front of the recoil spring. As a result an entire type of firearm design that features a recoil spring guide that extends forward of the front of the recoil spring cannot be protected from impact by this means.

OBJECTS AND ADVANTAGES

The principal object of the invention is to buffer the impact of moving parts set into motion by the firing of a firearm, a process commonly called recoil, that would normally be transmitted to the frame of the firearm when their movement is terminated.

In particular the invention permits the installation of a buffering mechanism in firearm designs where the rear of the recoil spring or springs are seated in a well in the frame of the firearm to the rear of the surface upon which the moving parts collide in the termination of their movement.

Another object of the invention is to provide a mechanism that may be adapted to a wide variety of firearms.

Another object of the invention is to provide a mechanism that may be easily retrofitted to a variety of existing firearms without the need for a skilled gunsmith.

Another object of the invention is to provide a mechanism that would not denigrate from the handling of the firearm when the mechanism is operated manually for the loading or unloading of ammunition.

It is a further object of the invention to produce a mechanism that would not add appreciably to the maintenance of the firearm and that would have a long service life.

Other objects will be in part obvious and in part pointed out in more detail later.

A better understanding of the objects, advantages, features, properties and relationships of the invention will be obtained from the following detailed description and accompanying drawings which set forth certain illustrative embodiments and is indicative of the way in which the principal of the invention is employed.

SUMMARY OF THE INVENTION

A impact-buffering recoil mechanism for firearms includes a buffer (3) (4) moveably mounted on a guiding member (1) (17) between a plurality of coil springs (2) (5). the mechanism is positioned sin the firearm so that the moveable buffer travels from a position of repose to interpose between moveable parts (7) of the firearm (16) set into motion by the firing of the firearm and the frame of the firearm (8). this interposing will bring the moveable parts to an orderly halt while dissipating impact energy that would normally be transmitted to the frame and hence to the shooter.

REFERENCE NUMERALS IN DRAWINGS

Figure 1:
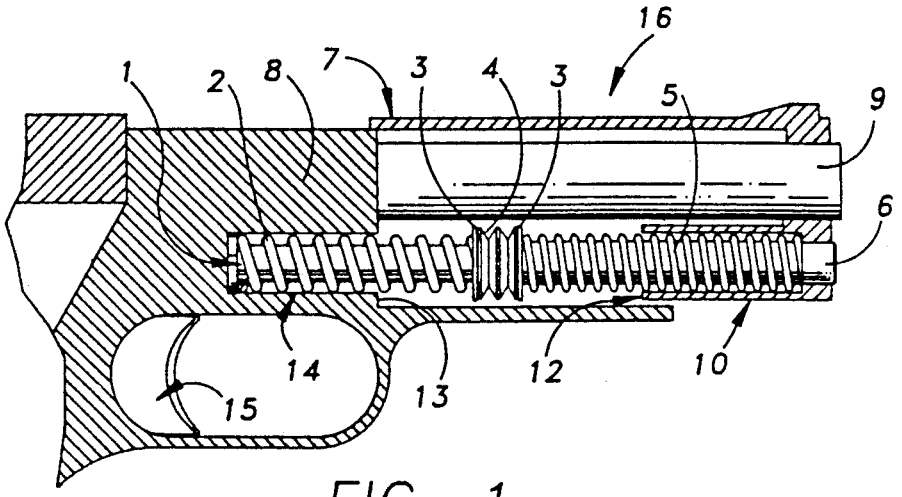
FIG. 1 is a partial cross-sectional side view of a conventional firearm, parts in repose, ready to fire with the impact buffering recoil mechanism in place.

1. end stop
2. buffer spring
3. end plates
4. belleville disc springs
5. slide spring
6. slide spring guide
7. moveable slide
8. frame
9. barrel
10. slide tunnel (A location)
11. rear surface of the slide spring guide (A location)
12. slide tunnel face (A location)

13. frame shoulder (A location)
14. spring well (A location)
15. trigger
16. firearm
17. assembly guide
18. sliding member
19. retaining means

DESCRIPTION OF THE INVENTION

Figure 6:
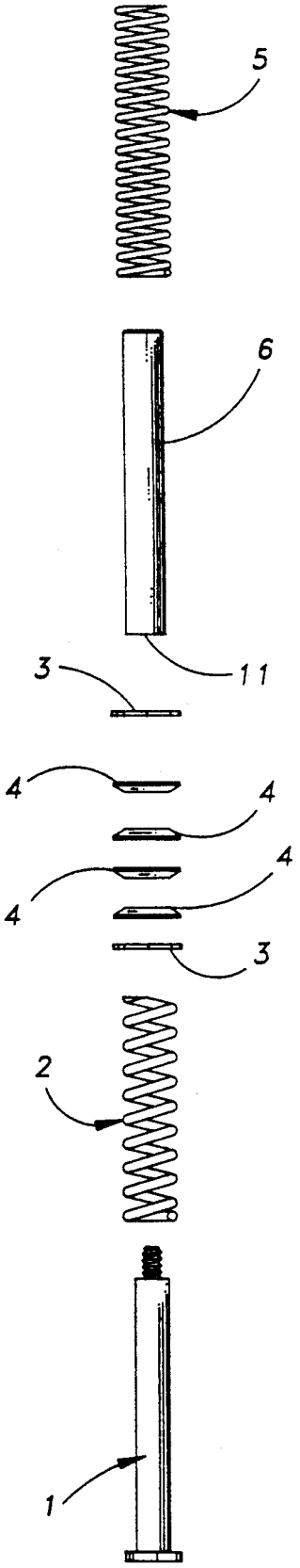
FIG. 6 is an exploded side view of a typical embodiment of the invention.

A typical embodiment of the present invention is illustrated in FIG. 6.

An end stop 1 is a cylindrical part having a radially enlarged head at the rear and a body that serves as a guide for a buffer spring 2, end plates 3 and belleville disc springs 4 at the front. The preferred material for the end stop is hardened steel to resist wear. The forward end of the body attaches to a slide spring guide 6 during assembly of the mechanism.

Figure 2:
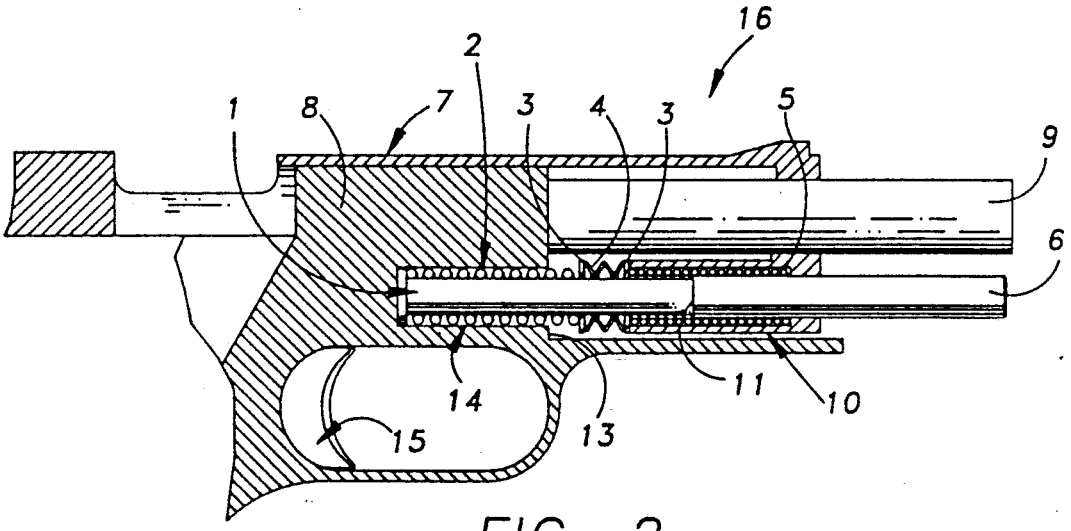
FIG. 2 is a partial cross-sectional side view of a conventional firearm with a moveable slide in movement from firing with the impact buffering recoil mechanism in place.
Figure 3:
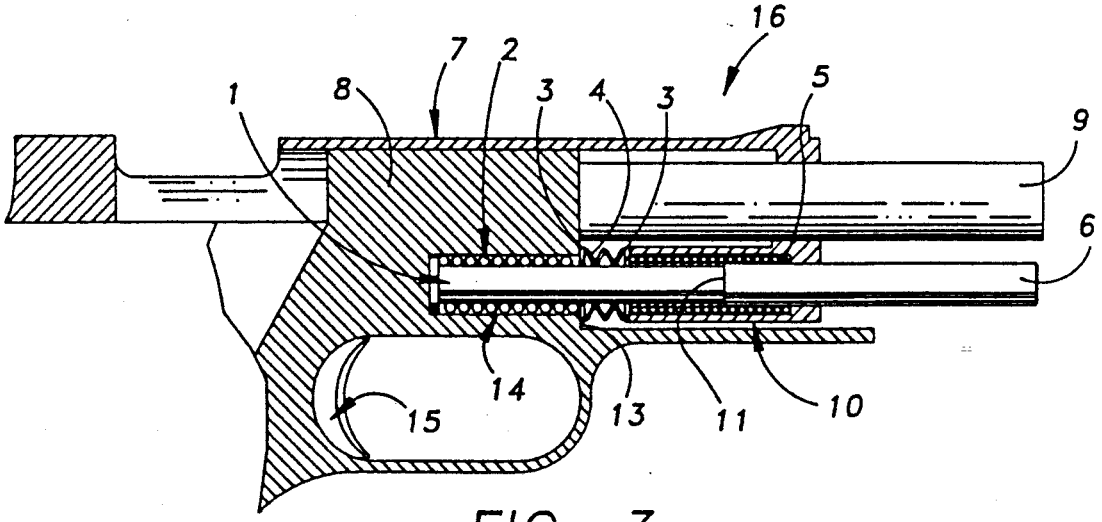
FIG. 3 is a partial cross-sectional side view of a conventional firearm with a moveable slide at the final stage of movement from firing with the impact buffering recoil mechanism in place.
Figure 5:
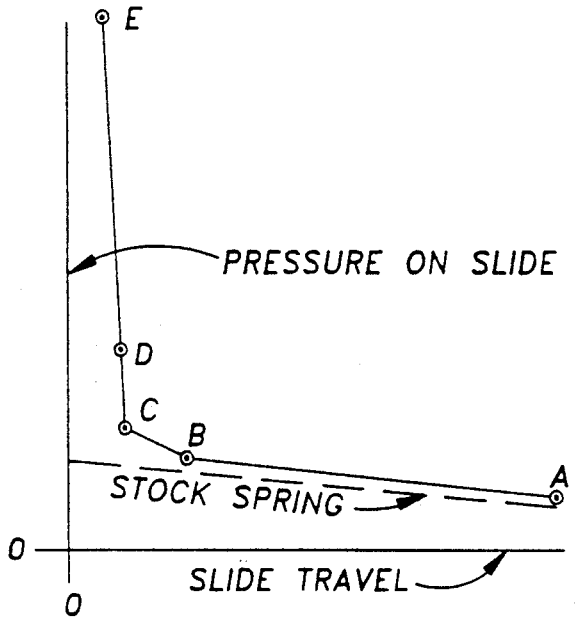
FIG. 5 is a graph showing the relationship between the pressure on a moveable slide during movement and its position during movement.

The buffer spring 2 is a coil spring selected to have a compressed solid length shorter than the depth of a spring well 14 FIG. 1-3 minus the height of the end stop head as well as to provide specific pressures at points B and C of FIG. 5.

The end plates 3 are washers of tempered steel to provide surfaces for the bellevilles 4 to flex against during compression. The end plates also provide support for the bellevilles in cases where the design of the firearm 16 FIG. 1-3 has part of a frame shoulder 13 FIG. 1-3 and/or a slide tunnel face 12 FIG. 1-3 removed.

Belleville disc springs 4 are common commercial components selected to stop the movable parts in recoil without compressing flat. In some applications it has been found advantageous to mix sizes of bellevilles to prevent a shock wave from being transmitted through them from the a moveable slide 7 to a frame 8 FIG. 1-3.

The belleville disc springs 4 and end plates 3 collectively compose the moveable buffer of the typical embodiment of the impact buffering recoil mechanism.

A slide spring 5 is a coil spring selected to have a solid compressed length shorter than the depth of a slide tunnel 10 FIG. 1-3 and to provide specific pressures at points A and B FIG. 5.

Slide spring guide 6 is a cylindrical part having a diameter greater than that of the body of the end stop 1. A rear surface of the slide spring guide 11 forms a shoulder Where it abuts to the front of the end stop 1 to entrap the buffer spring 2, end plates 3 and bellevilles 4 so that the entire mechanism minus slide spring 5 can be handled as a unit.

The slide spring 5 being separate can be interchanged with other springs of various powers to accommodate ammunition of different levels of power.

BEST MODE FOR CARRYING OUT THE INVENTION

A conventional firearm 16 as illustrated in FIG. 1-3 includes a frame 8 to which a barrel 9 and a moveable slide 7 are mounted. Between the frame 8 and a moveable slide 7 an impact buffering recoil mechanism with end stop 1, buffer spring 2, end plates 3 and belleville disc springs 4, slide spring 5 and slide spring guide 6 are mounted. FIG. 1 illustrates the relationship of the parts in a position of repose, ready for the depressing of a trigger 15 to fire the firearm.

Upon the firing of the firearm the slide will reactively travel to the rear compressing the less powerful slide spring 5 and to a lesser degree the more powerful buffer spring 2. This movement will correspond to section A to B FIG. 5. Note the modest increase in pressure placed on the slide.

FIG. 2 corresponds to section B to C FIG. 5. The slide spring 5 has been compressed to the maximum amount permitted by its position in a slide tunnel 10. The end plates 3 and bellevilles 4, which collectively compose the moveable buffer of the invention, are being pushed to the rear by a slide tunnel face 12 compressing the buffer spring 2 against the head of the end stop 1. The compressing of the more powerful buffer spring 2 results in a greater increase in spring pressure between points B and C FIG. 5.

FIG. 3 illustrates the firearm with the slide at the end of its rearward movement. This corresponds to section C to E FIG. 5. The slide spring 5 has been compressed to the maximum amount permitted by its position in a spring well 14. The bellevilles 4 are now being compressed between the end plates 3 which are in turn entrapped between a frame shoulder 13 and the slide tunnel turn entrapped between a frame shoulder 13 and the slide tunnel face 12. The rearward movement of the slide 7 will terminate at point D FIG. 5, at a point short of E FIG. 5 where the bellevilles 4 would have been compressed flat. This will result in all of the slide energy being depleted short of the slide tunnel face 12 slamming into the frame shoulder 13.

The sequential compression of the slide spring 5, buffer spring 2 and the belleville disc springs 4 result in the "L" shaped pressure curve in FIG. 5. The advantage of this curve rather than a straight line from A to D is that it permits the slide 7 to establish a momentum level sufficient for the reliable functioning of the firearm 16 and permits the firearm to be more readily functioned by hand in the loading and unloading of ammunition. The ease of manually functioning the firearm is a distinct safety advantage since the pressure required to manually operate the slide 7 from point A to B is a close duplication of the original stock spring of the firearm.

A slide spring guide 6 is of larger size than the body of the end stop 1 so that the mechanism can be handled as a unit with the buffer spring 2, end plates 3 and bellevilles 4 being entrapped between the head of the end stop 1 and a rear surface of the recoil spring guide 11. This feature will avoid presenting the shooter with a multitude of small and easily lost parts during disassembly of the firearm for maintenance. The slide spring 5 is easily exchanged during disassembly for one of a different power to accommodate ammunition of differing levels of power.

Figure 4:
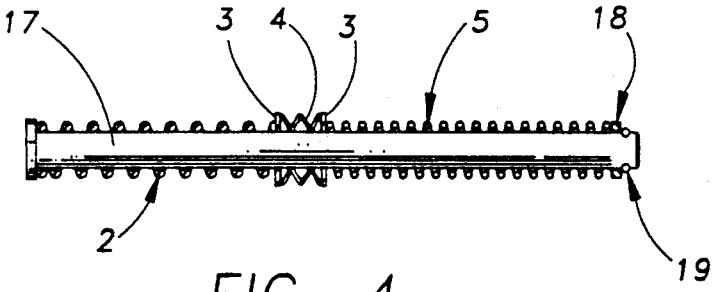
FIG. 4 is a cross-sectional side view of an alternative embodiment of the invention.

FIG. 4 illustrates an alternative embodiment of the invention wherein the end stop 1 and the recoil spring guide 6 are replaced by a single assembly guide 17 which entraps the buffer spring 2, end plates 3, bellevilles 4 and slide spring 5 between an radially enlarged head at the rear and a sliding member 18 at the front held on the assembly guide 17 by a retaining means 19. As illustrated in FIG. 4 the buffer spring 2 and slide spring 5 are partially compressed. When installed in the firearm 16 the sliding member 18 is pushed slightly to the rear by the bottom of the slide tunnel 10 relieving pressure from the retaining means 19 and applying it to the slide 7. The functioning of the alternative embodiment is the same as for the invention.

A resilient sheet of an energy-dissipating material may be substituted for the belleville disc springs 4 in the moveable buffer.

One or both of the end plates 3 in the movable buffer may be unnecessary for some applications of the invention.

As will be apparent to persons skilled in the art, various modifications, adaptations and variations of the foregoing specific disclosures can be made without departing from the teaching of the invention.

I claim:

1. In combination:

a firearm with a frame having forward and rearward ends and a movable slide member thereon movable rearwardly on said frame in response to firing of the firearm;

a guide member having forward and rearward ends, the rearward end located in contact with a portion of said frame so as to prevent rearward movement of said guide member, and the forward end slidably connected to said movable slide member to permit rearward slidable movement of said slide member upon firing of the firearm;

an impact buffering means operably mounted between said frame and slide member for buffering the impact of said slide member against said frame after firing of the firearm;

said impact buffer means including:

a first biasing means having rearward and forward ends, the rearward end in abutting contact with said frame to prevent rearward movement of said first biasing means;

a second biasing means having rearward and forward ends operably mounted on said guide member forwardly of said first biasing means, the rearward end connected to the forward end of said first biasing means;

a third biasing means operably mounted on said guide member, having rearward and forward ends, the rearward end connected to the forward end of said second biasing means and the forward end being in contact with said movable slide member;

said first second and third biasing means biasing against rearward movement of said moveable slide member upon firing of the firearm;

said second biasing means having a biasing force greater than said first and third biasing means;

said second biasing means operably mounted on said guide for slidable movement between first and third biasing means.

2. The combination of claim 1, wherein said first biasing means has a biasing force greater than said third biasing means.

3. The combination of claim 1, wherein said first and third biasing means are coil springs coiled around said guide member.

4. The combination of claim 1, wherein second biasing means includes a disk spring.

5. The combination of claim 4, wherein said disk spring has an end plate on the forward and rearward ends thereof.

6. The combination of claim 1, wherein second biasing means includes a sheet of resiliently compressible energy dissipating material.

7. The combination of claim 2, further comprising stop means mounted on said side member for movement therewith, positioned to engage the forward end of said second biasing means after a predetermined amount of biasing of said third biasing means, to prevent further biasing of said third biasing means.

8. The combination of claim 7, wherein said stop means includes a hollow cylindrical member forming a tunnel to receive said third biasing means therein upon biasing of said third biasing means, said tunnel having a length approximately equal to the length of the fully biased third biasing means.

9. The combination of claim 7, further comprising second stop means on said frame positioned to engage the rearward end of said second biasing means after a predetermined amount of biasing of said first biasing means, to prevent further biasing of said first biasing means.

10. The combination of claim 9, wherein said second stop means includes a well formed in said frame adapted to receive said first biasing means therein, said well having a depth approximately equal to the length of said first biasing means when fully biased.

11. The combination of claim 4, wherein said second biasing means is longitudinally movable along said guide member between said first and third biasing means.

12. The combination of claim 1, wherein said guide member includes a radially enlarged head at the rearward end against which the rearward end of said first biasing means will contact to retain said biasing means on said guide member.

13. An impact buffering recoil mechanism for firearms, for dissipating the recoil of a slide member slidably mounted on a firearm frame upon firing of the firearm, comprising:

an elongated member having forward and rearward ends;

first biasing means operably mounted on said guide member, and operable between a compressed, fully biased position, and an unbiased position, said biasing means having rearward and forward ends;

means on the rearward end of said guide member for preventing rearward movement of the rearward end of said first biasing means, whereby said first biasing means may be biased against said stop means;

second biasing means operably mounted on said guide member, having forward and rearward ends and operable between biased and unbiased positions, said second biasing means positioned forwardly of said first biasing means in contact with the forward end of the first biasing means; and third biasing means operably mounted on said guide member forwardly of said biasing means, having forward and rearward ends and operable between biased and unbiased conditions; the rearward end of said third biasing means in contact with the forward end of said second biasing means so as to bias there against;

said second biasing means operably mounted on said guide member for longitudinal movement there along between said first and third biasing means.

14. The recoil mechanism of claim 13, wherein said second biasing means has a greater biasing force than said first biasing means, and wherein said first biasing means has a greater biasing force than said third biasing means , whereby said second biasing means will not be moved to its biased position until said first biasing means has been fully biased, and whereby said first biasing means will not be moved to its biased position until said third biasing means has been fully biased.

* * * * *